US009371715B2

(12) United States Patent
George et al.

(10) Patent No.: US 9,371,715 B2
(45) Date of Patent: Jun. 21, 2016

(54) DOWNHOLE EXTENDING PORTS

(75) Inventors: Grant George, Kelowna (CA); Shane Sargent, Kelowna (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 634 days.

(21) Appl. No.: 13/274,761

(22) Filed: Oct. 17, 2011

(65) Prior Publication Data

US 2012/0267122 A1 Oct. 25, 2012

Related U.S. Application Data

(60) Provisional application No. 61/344,812, filed on Oct. 15, 2010.

(51) Int. Cl.

| | |
|---|---|
| ***E21B 34/10*** | (2006.01) |
| ***E21B 34/14*** | (2006.01) |
| ***E21B 43/26*** | (2006.01) |
| *E21B 34/00* | (2006.01) |

(52) U.S. Cl.

CPC ..... *E21B 34/14* (2013.01); *E21B 43/26* (2013.01); *E21B 2034/007* (2013.01)

(58) Field of Classification Search

CPC ..... E21B 41/0078

USPC ..... 166/373, 374, 377, 177.5, 22, 223, 317, 166/334.1

See application file for complete search history.

(56) References Cited

U.S. PATENT DOCUMENTS

| | | | | |
|---|---|---|---|---|
| 2,775,304 | A | 12/1956 | Zandmer | |
| 4,287,946 | A * | 9/1981 | Brieger | 166/100 |
| 5,249,628 | A | 10/1993 | Surjaatmadja | |
| 5,325,923 | A | 7/1994 | Surjaatmadja et al. | |
| 5,361,856 | A | 11/1994 | Surjaatmadja et al. | |
| 5,379,838 | A | 1/1995 | Wilson et al. | |
| 5,396,957 | A | 3/1995 | Surjaatmadja et al. | |
| 5,425,424 | A | 6/1995 | Reinhardt et al. | |
| 5,494,103 | A | 2/1996 | Surjaatmadja et al. | |
| 6,380,138 | B1 | 4/2002 | Ischy et al. | |
| 7,267,172 | B2 | 9/2007 | Hofman | |
| 7,387,165 | B2 * | 6/2008 | Lopez de Cardenas et al. | 166/313 |
| 7,422,060 | B2 | 9/2008 | Hammami et al. | |
| 7,422,069 | B2 | 9/2008 | Richard et al. | |
| 7,591,312 | B2 | 9/2009 | Johnson et al. | |
| 7,604,055 | B2 | 10/2009 | Richard et al. | |
| 2002/0007949 | A1 | 1/2002 | Tolamn et al. | |

(Continued)

*Primary Examiner* — William P Neuder

*Assistant Examiner* — Richard Alker

(74) *Attorney, Agent, or Firm* — Jeffery R. Peterson; Brandon Clark

(57) ABSTRACT

A method and apparatus for centering and engaging a casing against a wellbore. The apparatus comprises a valve body locatable in-line with the casing the valve body having an outer casing extending between first and second ends and a central passage therethrough, and at least one radially movable body extending therethrough. Each radially movable body has an aperture therethrough so as to permit an exterior of the valve body and the central passage to be in fluidic communication with each other. The apparatus further comprises a cylinder and a piston therein operable connected to the radially movable body in selective fluidic communication with the central passage. The method comprises locating the valve body in line with a wellbore casing, pressurizing the casing with a pressurizing fluid and transmitting the pressurizing fluid the cylinder so as to displace a piston located therein and extend the radially movable body.

14 Claims, 17 Drawing Sheets

(56) References Cited

U.S. PATENT DOCUMENTS

| | | | | |
|---|---|---|---|---|
| 2006/0207763 | A1 | 9/2006 | Hofman | |
| 2009/0044944 | A1 * | 2/2009 | Murray et al. | 166/308.1 |
| 2010/0122817 | A1 | 5/2010 | Surjaatmadja et al. | |
| 2012/0118573 | A1 | 5/2012 | Richard et al. | |
| 2012/0125627 | A1 | 5/2012 | George et al. | |
| 2012/0152550 | A1 | 6/2012 | East, Jr. | |
| 2013/0048273 | A1 | 2/2013 | Crow et al. | |

* cited by examiner

DOWNHOLE EXTENDING PORTS

CROSS REFERENCE TO RELATED APPLICATION

This application claims priority from U.S. Provisional Patent Application No. 61/344,812 filed Oct. 15, 2010 entitled Downhole Control Valve System.

BACKGROUND OF THE INVENTION

1. Field of Invention

The present invention relates to hydrocarbon well control in general and in particular methods and apparatuses for selectably opening and closing zones within a hydrocarbon well during completion, hydraulic fracturing or production.

2. Description of Related Art

In hydrocarbon production, it has become common to utilize directional or horizontal drilling to reach petroleum containing rocks, or formations, that are either at a horizontal distance from the drilling location. Horizontal drilling is also commonly utilized to extend the wellbore along a horizontal or inclined formation or to span across multiple formations with a single wellbore. With horizontal drilling the well casing is prone to resting upon the bottom of the wellbore requiring the use of spacers so as to centre the casing within the wellbore.

In horizontal hydrocarbon wells, it is frequently desirable to select which zone of the wellbore is to be opened for production or to stimulate one or more zones of the well to increase production of that zone from time to time. One current method of stimulating a portion of the well is through the use of hydraulic fracturing or fracing. One difficulty with conventional fracing systems, it that is necessary to isolate the zone to be stimulated on both the upper and lower ends thereof so as to limit the stimulation to the desired zone. Such isolation has typically been accomplished with sealing elements known as production packers located to either side of the zone to be isolated.

One of the prior problems with current fracing methods is that most hydrocarbon wells are constructed with a well casing located within the wellbore which is cemented in place by pumping cement down the casing to the bottom of the well so as to fill the annulus between the casing and the wellbore from the bottom up. Such concrete provides an additional barrier between the center of the well casing and wellbore which is to be fraced. In conventional methods, in order to thereafter frac a zone which has been constructed in such a manner, it is necessary to form a conduit from the interior of the casing to the wellbore wall by fracturing the cement as well as the formation. Needing to fracture the concrete as well as the formation increases the pressure required for the fracing process thereby increasing the equipment requirements as well as the resulting cost and time requirements.

Previous attempts to resolve some of the above difficulties has been to provide valves inline within the casing so as to selectably provide access to the desired zones of the well. Such valves may be sliding valves having actuators such as are described in US Patent Application Publication No. 2006/0207763 to Hofman published Sep. 21, 2006. With the use of such sliding valves however, it is still necessary to fracture, dissolve or otherwise perforate the concrete surrounding the casing to access the formation.

SUMMARY OF THE INVENTION

According to a first embodiment of the present invention there is disclosed an apparatus for centering and engaging a casing against a wellbore. The apparatus comprises a valve body locatable in-line with a wellbore casing, at least one cylinder associated with the valve body and a central passage extending between an interior of the casing so as to transmit a pressure within the valve body to the at least one cylinder. The apparatus further includes a piston slidably locatable within the at least one cylinder operable to be displaced by the pressure and at least one port body slidably locatable within the valve body, the port body having an aperture therethrough and being connected to the piston so as to extend the port body from the valve body into contact with the wellbore as the piston is displaced.

According to a further embodiment of the present invention there is disclosed an apparatus for centering and engaging a casing against a wellbore. The apparatus comprises a valve body locatable in-line with the casing, the valve body having an outer casing extending between first and second ends and having a central passage therethrough and at least one radially movable body extending through the outer casing. Each radially movable body has an aperture therethrough so as to permit an exterior of the valve body and the central passage to be in fluidic communication with each other. The apparatus further comprises an actuator for radially moving the radially movable body.

The actuator may comprises at least one cylinder associated with the at least one radially moveable body, each cylinder having a piston therein operable connected to the radially movable body. The cylinder may be in selective fluidic communication with the central passage such that a pressurized fluid in the central passage selectably displaces the piston within the cylinder so as to extend the radially movable body.

The apparatus may further comprise a fluid bore extending between an interior of the casing and the at least one cylinder. The fluid bore may include a selectably removable plug. The selectably removable plug may selectably seal an inlet of the fluid bore within the central passage. The plug may be frangibly connected to the inlet of the fluid bore.

The fluid bore may include a lower limit pressure relief check valve for preventing actuation of the pistons in the cylinders until a fluid in the central passage reaches a predetermined pressure. The fluid bore may include an upper limit pressure relief valve for preventing the pressure in the cylinder from exceeding a predetermined pressure. The upper limit relieve valve may vent to an exterior of the valve body.

The apparatus may further comprise a pair of cylinders and associated pistons located to opposed sides of the radially movable body. The radially movable body may be movable between first and second positions, the first position being retracted into the valve body, the second position extending radially from the valve body. The radially movable body may include an exterior surface, the exterior surface being substantially aligned with an exterior of the valve body in the first position. The radially movable body may extend from the valve body by a distance sufficient for the exterior surface to engage the wellbore in the second position.

The apparatus may further comprise a valve member for selectably covering the aperture so as to isolate the central passage from an exterior of the valve body. The valve member may comprise an axially slidably sleeve located within the central passage.

According to a further embodiment of the present invention there is disclosed a method of centering and engaging a valve body against a wellbore. The method comprises locating a valve body in line with a wellbore casing, the valve body having an outer casing extending between first and second ends and a central passage therethrough, pressurizing the casing with a pressurizing fluid and transmitting the pressurizing fluid to at least one cylinder within the valve body with the pressurizing fluid so as to displace a piston located therein and extend at least one radially movable body operably connected to the piston. The radially movable body extends through the valve body and has an aperture therethrough so as to permit an exterior of the valve body and the central passage to be in fluidic communication with each other.

According to a further embodiment of the present invention there is disclosed a method of centering and engaging a valve body against a wellbore comprising providing a valve body in line with a wellbore casing and pumping a volume of concrete down the casing to fill the annulus around the casing with a wellbore plug following the concrete. The method further comprise pressurizing the casing with a pressurizing fluid, pressurizing at least one piston with the pressurizing fluid so as to displace a piston located therein and extending at least one body having an aperture therethrough operably connected to the piston from the casing into contact with the wellbore.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
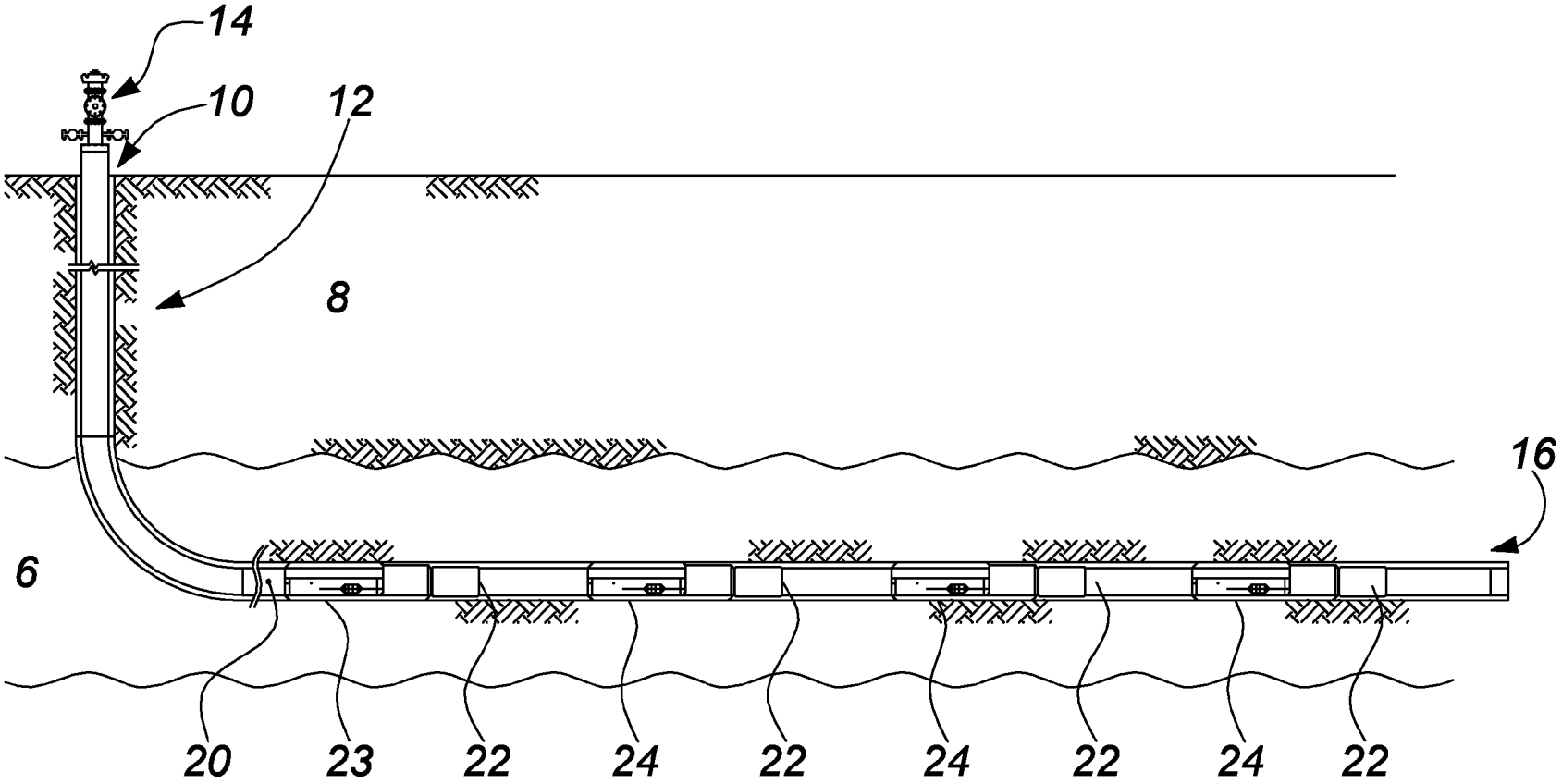
FIG. 1 is a cross-sectional view of a wellbore having a plurality of flow control valves according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 is of the hydrocarbon well is formed of a plurality of alternating liner or casing 22 sections and in line valve bodies 24 surrounded by a layer of cement 23 between the casing and the wellbore. The valve bodies 24 are adapted to control fluid flow from the surrounding formation proximate to that valve body and may be located at predetermined locations to correspond to a desired production zone within the wellbore. In operation, between 8 and 100 valve bodies may be utilized within a wellbore although it will be appreciated that other quantities may be useful as well.

Figure 2:
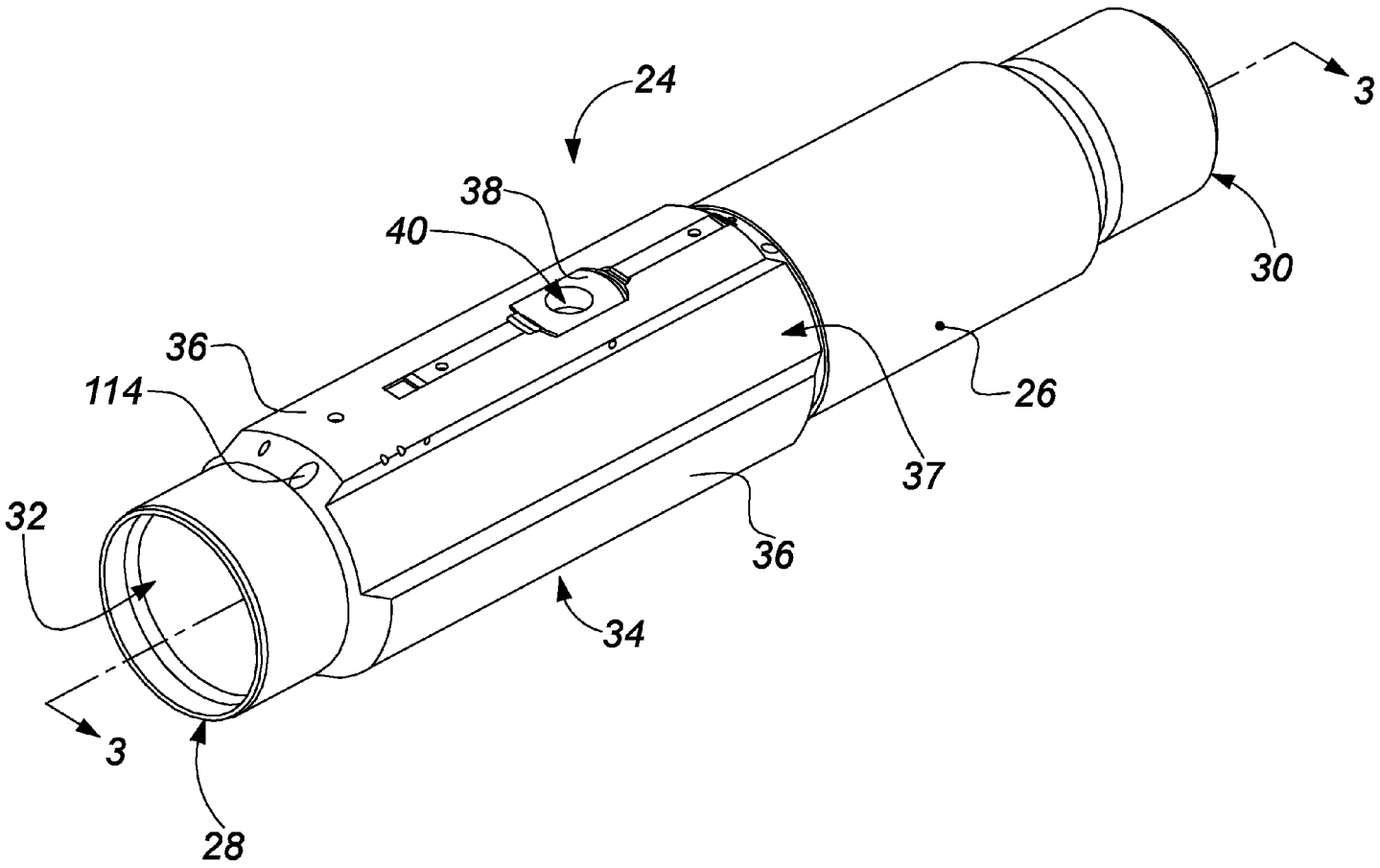
FIG. 2 is a perspective view of one of the control valves of FIG. 1.

Turning now to FIG. 2, a perspective view of one valve body 24 is illustrated. The valve body 24 comprises a substantially elongate cylindrical outer casing 26 extending between first and second ends 28 and 30, respectively and having a central passage 32 therethrough. The first end 28 of the valve body is connected to adjacent liner or casing section 22 with an internal threading in the first end 28. The second end 30 of the valve body is connected to an adjacent casing section with external threading around the second end 30. The valve body 24 further includes a central portion 34 having a plurality of raised sections 36 extending axially therealong with passages 37 therebetween. As illustrated in the accompanying figures, the valve body 24 has three raised sections although it will be appreciated that a different number may also be utilized.

Each raised section 36 includes a radially movable body or port body 38 therein having an aperture 40 extending therethrough. The aperture 40 extends from the exterior to the interior of the valve body and is adapted to provide a fluid passage between the interior of the bottom section 16 and the wellbore 10 as will be further described below. The aperture 40 may be filled with a sealing body (not shown) when installed within a bottom section 16. The sealing body serves to assist in sealing the aperture until the formation is to be fractured and therefore will have sufficient strength to remain within the aperture until that time and will also be sufficiently frangible so as to be fractured and removed from the aperture during the fracing process. Additionally, the port bodies 38 are radially extendable from the valve body so as to engage an outer surface thereof against the wellbore 10 so as to center the valve body 24 and thereby the production section within the wellbore.

Figure 3:
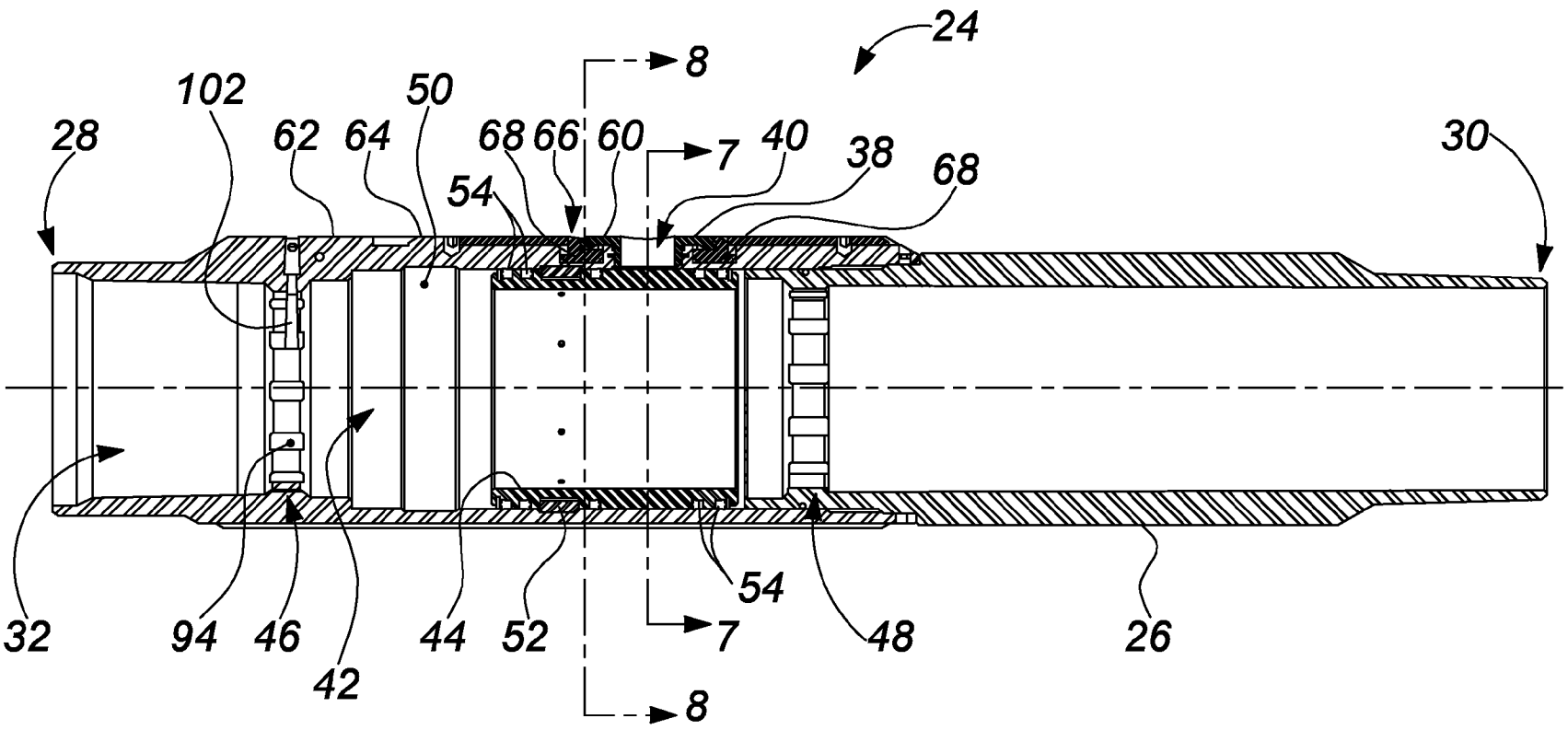
FIG. 3 is a longitudinal cross-sectional view of the control valve of FIG. 2 as taken along the line 3-3.

Turning now to FIG. 3, a cross sectional view of the valve body 24 is illustrated. The central passage 32 of the valve body includes a central portion 42 corresponding to the location of the port bodies 38. The central portion is substantially cylindrical and contains a sliding sleeve 44 therein. The central portion 42 is defined between first or entrance and second or exit raised portions or annular shoulders, 46 and 48, respectively. The sliding sleeve 44 is longitudinally displaceable within the central portion 42 to either be adjacent to the first or second shoulder 46 or 48. At a location adjacent to the second shoulder, the sliding sleeve 44 sealably covers the apertures 40 so as to isolate the interior from the exterior of the bottom section 16 from each other, whereas when the sliding sleeve 44 is adjacent to the first shoulder 46, the sliding sleeve 44

Figure 4:
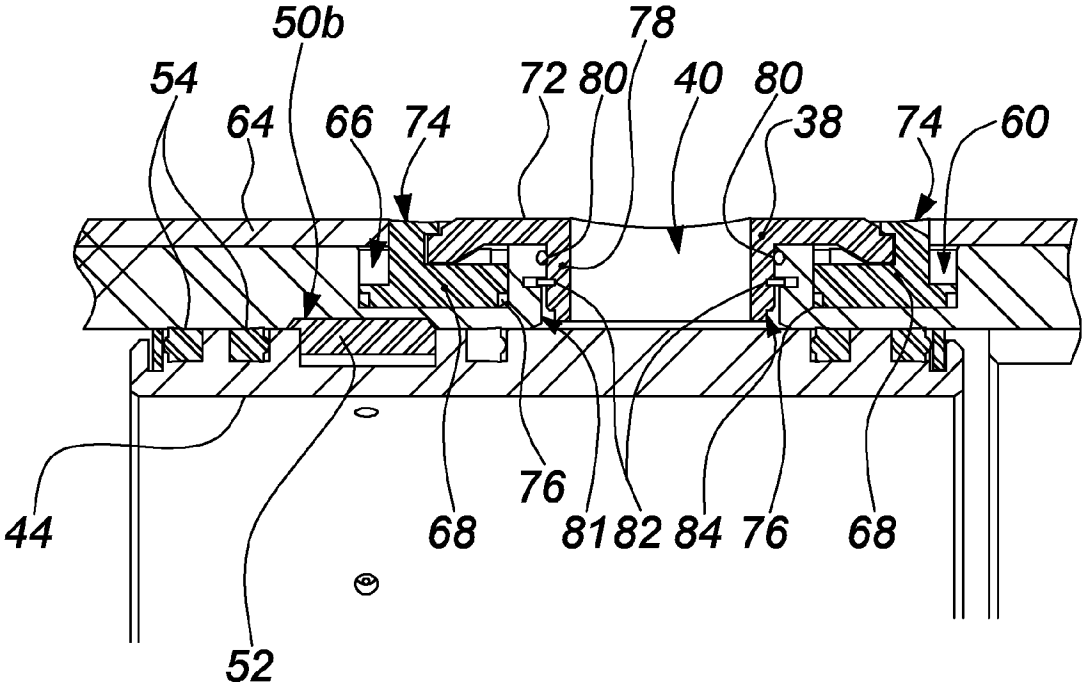
FIG. 4 is a detailed cross-sectional view of the extendable ports of the valve of FIG. 2 in a first or retracted position.
Figure 5:
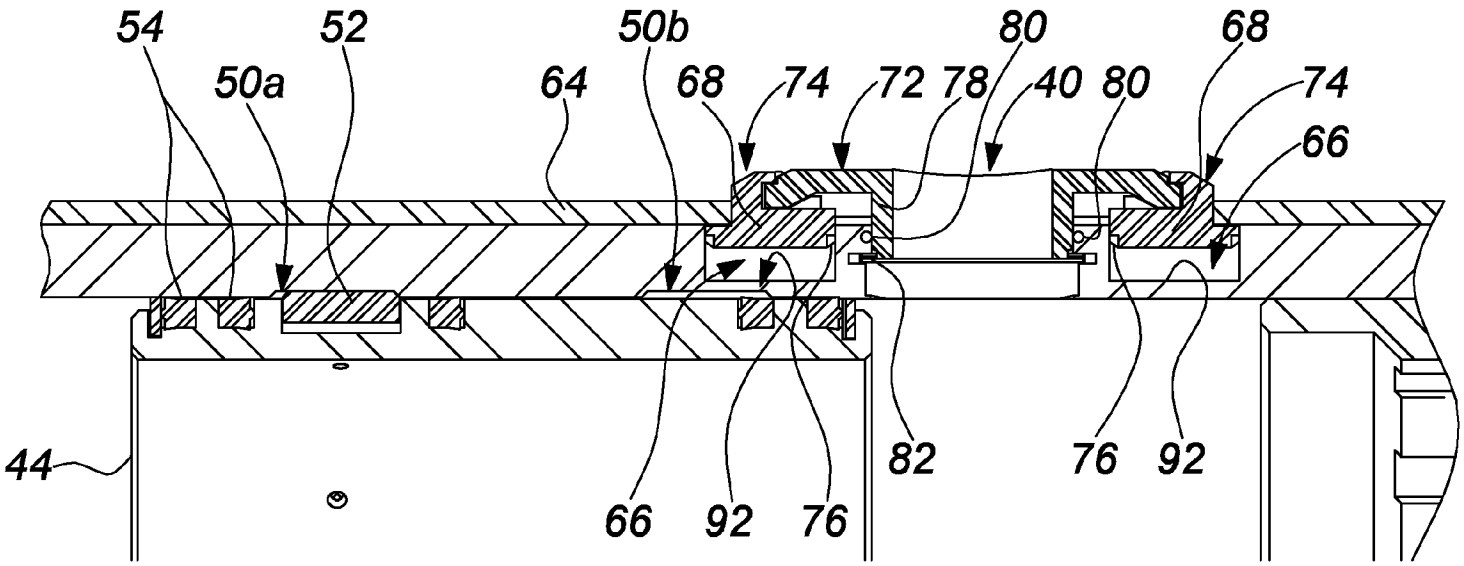
FIG. 5 is a detailed cross-sectional view of the extendable ports of the valve of FIG. 2 in a second or extended position with the sleeve valve in an open position.

The central portion 42 includes a first annular groove 50*a* therein proximate to the first shoulder 46. The sliding sleeve 44 includes a radially disposed snap ring 52 therein corresponding to the groove 50*a* so as to engage therewith and retain the sliding sleeve 44 proximate to the first shoulder 46 which is an open position for the valve body 24. The central portion 42 also includes a second annular groove 50*b* therein proximate to the aperture 40 having a similar profile to the first annular groove 50*a*. The snap ring 52 of the sleeve is receivable in either the first ore second annular groove 50*a* or 50*b* such that the sleeve is held in either an open position as illustrated in FIG. 5 or a closed position as illustrated in FIG. 4. The sliding sleeve 44 also includes annular wiper seals 54 which will be described more fully below proximate to either end thereof to maintain a fluid tight seal between the sliding sleeve and the interior of the central portion 42.

The port bodies 38 are slidably received within the valve body 24 so as to be radially extendable therefrom. As illustrated in FIG. 3, the port bodies are located in their retracted position such that an exterior surface 60 of the port bodies is aligned with an exterior surface 62 of the raised sections 36. Each raised section may also include limit plates 64 located to each side of the port bodies 38 which overlap a portion of and retain pistons within the cylinders as are more fully described below.

Each raised section 36 includes at least one void region or cylinder 66 disposed radially therein. Each cylinder 66 includes a piston 68 therein which is operably connected to a corresponding port body 38 forming an actuator for selectably moving the port bodies 38. Turning now to FIGS. 4 and 5, detailed views of one port body 38 are illustrated at a retracted and extended position, respectively. Each port body 38 may have an opposed pair of pistons 68 associated therewith arranged to opposed longitudinal sides of the valve body 24. It will be appreciated that other quantities of pistons 68 may also be utilized for each port body 38 as well. The pistons 68 are connected to the valve body by a top plate 70 having an exterior surface 72. The exterior surface 72 is positioned to correspond to the exterior surface 62 of the raised sections 36 so as to present a substantially continuous surface therewith when the port bodies 38 are in their retracted positions. The exterior surface 72 also includes angled end portions 74 so as to provide a ramp or inclined surface at each end of the port body 38 when the port bodies 38 are in an extended position. This will assist in enabling the valve body to be longitudinally displaced within a wellbore 10 with the vertical section 12 under thermal expansion of the production string and thereby to minimize any shear stresses on the port body 38.

The pistons 68 are radially moveable within the cylinders relative to a central axis of the valve body so as to be radially extendable therefrom. In the extended position illustrated in FIG. 5, the exterior surface 72 of the port bodies are adapted to be in contact with the wellbore 10 so as to extend the port body 38 and thereby enable the wellbore 10 to be placed in fluidic communication with the central portion 42 of the valve body 24. The pistons 68 may have a travel distance between their retracted positions and their extended positions of between 0.10 and 0.50 inches although it will be appreciated that other distances may also be possible. In the extended position, it will be possible to frac that location without having to also fracture the concrete which will be located between the valve body 24 and the wellbore wall thereby reducing the required frac pressure. Additionally, more than one port body 38 may be utilized and radially arranged around the valve body so as to centre the valve body within the wellbore when the port bodies are extended therefrom.

The pistons 68 may include seals 76 therearound so as to seal the piston within the cylinders 66. Additionally, the port body 38 may include a port sleeve 78 extending radially inward through a corresponding port bore 81 within the valve body. A seal 80 may be located between the port sleeve 78 and the port bore 81 so as to provide a fluid tight seal therebetween. A snap ring 82 may be provided within the port bore 81 adapted to bear radially inwardly upon the port sleeve 78. In the extended position, the snap ring 82 compresses radially inwardly to provide a shoulder upon which the port sleeve 78 may rest so as to prevent retraction of the port body 38 as illustrated in FIG. 5.

Figure 6:
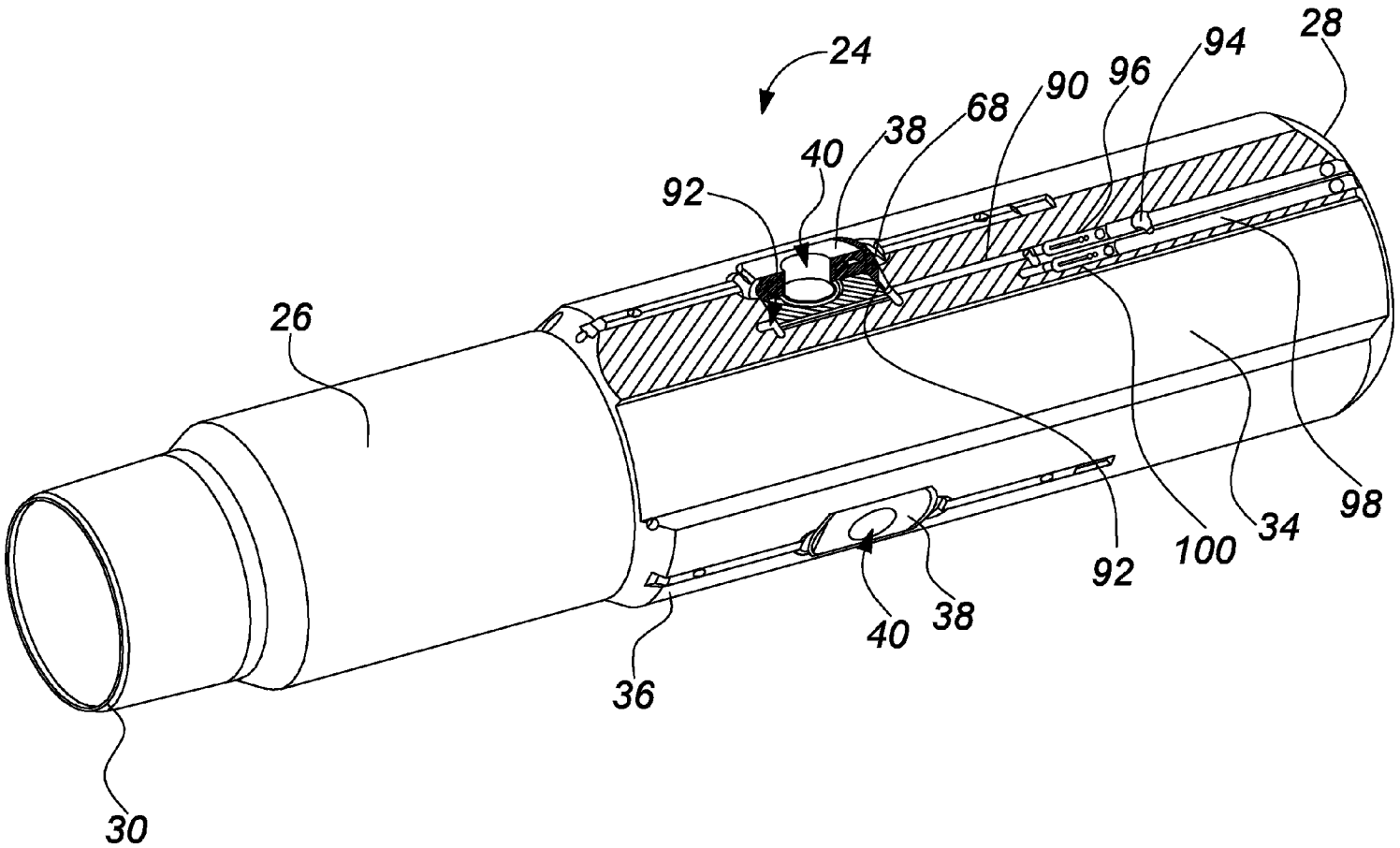
FIG. 6 is a partial cross-sectional view of one raised portion of the valve body of FIG. 2 illustrating a fluid control system for extending the FIG. 7 is an axial cross-sectional view of the control valve of FIG. 2 as taken along line 7-7.
Figure 8:
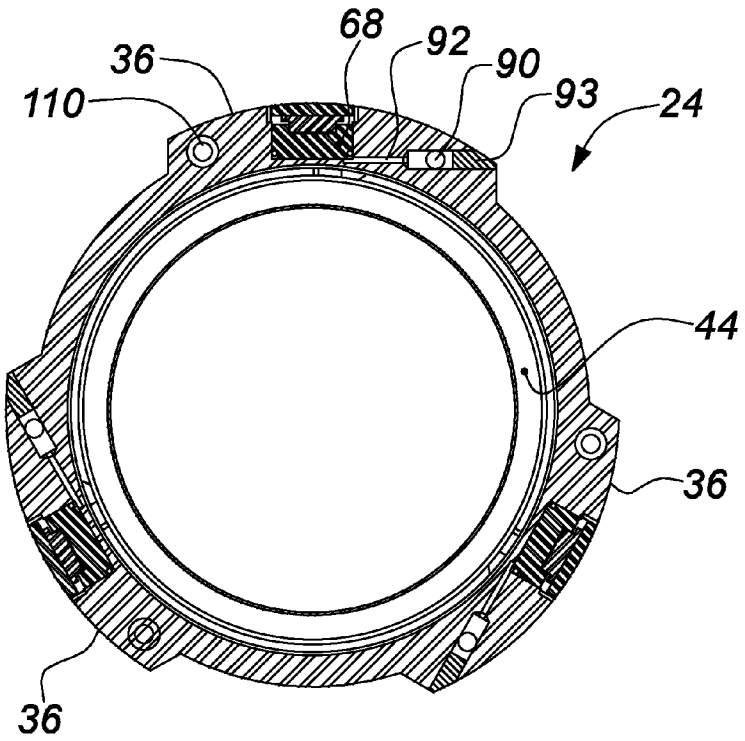
FIG. 8 is an axial cross-sectional view of the control valve of FIG. 2 as taken along line 8-8.

The pistons 68 may be displaceable within the cylinders 66 by the introduction of a pressurized fluid into a bottom portion thereof. As illustrated in FIG. 6, a fluid control system is illustrated for providing a pressurized fluid to the bottom portion of the cylinder 66 from the interior of the valve body 24. In this way a fluid pumped down the center of the bottom section 16 may be utilized to extend the port bodies 38. The fluid control system comprises a fluid bore 90 extending longitudinally within the raised section 36 between an entrance bore 94 and a pair of spaced apart piston connection bores 92. The piston connection bores 92 intersect the bottom portion of the cylinders 66 while the entrance bore extends to the central passage 32 of the valve body 24. The fluid bore 90 may include a relief check valve 96 located therein so as to only pressurize the cylinders 66 when a fluid of a sufficient pressure has been pumped down the production string. In operation, a user may select a check valve 96 of the desired actuation pressure which may be between 500 and 2000 pounds per square inch (psi) with a pressure of between 1000 and 1200 being particularly useful. Other pressures may also be selected which are sufficient to centralize the valve body 24 within the wellbore. This pressure may be referred to as an extension pressure. The fluid control system also includes a relieve bore 98 extending from the fluid bore 90 to an exterior of the valve body 24. As illustrated in FIG. 8, the piston connection bores 92 may be formed by boring into the raised section 36 so as to intersect both the fluid bore 90 and the cylinder 66 and thereafter filing the exterior portion of the piston connection bores with a piston connection plug 93 or the like.

The relief bore 98 includes a relief check valve 100 therein and is adapted to relieve the pressure within the fluid control system and to ensure that the pressure therein as well as within the bottom portion of the cylinders 66 does not reach a pressure which may cause damage to apparatus. In particular, as the extension pressure will be typically selected to be below the pressure required to fracture the formation, or the frac pressure, it will be necessary to ensure that such a higher frac pressure does not rupture the cylinder when it is applied to the interior of the bottom section 16. Frac pressures are known to often be 10,000 psi or higher and therefore the relief check valve 100 may be selected to have a opening pressure of between 5,000 and 8,000 psi.

With reference to FIG. 3, the entrance bore 94 intersect the central passage 32 of the valve body 24. As illustrated each entrance bore 94 may be covered by a knock-out plug 102 so as to seal the entrance bore until removed. In operation, as concrete is pumped down the bottom section 16, it will be followed by a plug so as to provide an end to the volume of concrete. The plug is pressurized by a pumping fluid (such as water, by way of non-limiting example) so as to force the concrete down the production string and thereafter to be extruded into the annulus between the horizontal section and the wellbore. The knock-out plugs 102 are designed so as to be removed or knocked-out of the entrance bore by the concrete plug passing thereby. In such a way, once the concrete has passed the valve body 24, the concrete plug removes the knock-out plugs 102 so as to pressurize the entrance bore 94 and fluid bore 90 and thereafter to extend the pistons 68 from the valve body 24 once the pressurizing fluid has reached a sufficient pressure.

Figure 7:
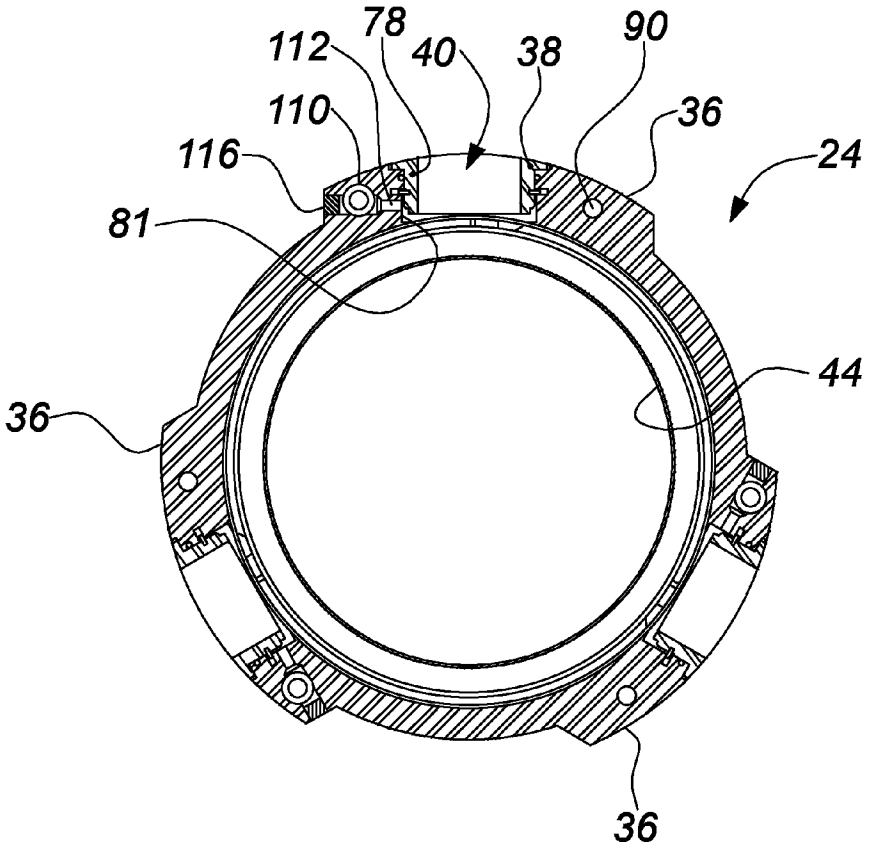

With reference to FIGS. 7 and 8, axial cross-sectional view of the valve body 24 is illustrated through the center of the aperture 40 and port body 38 and through the center of the pistons 68, respectively. Each raised section 36 includes a balancing bore 110 extending therealong substantially parallel to the central axis of the valve body 24. The balancing bore 110 extending between and entrance end 114 (shown on FIG. 2) and a connection bore 112 extending to the port bore 81. The balancing bore 110 may include a piston therein and be pre-filled with a fluid such as oil, by way of non-limiting example. In operation, the balancing bore 110 balances the pressure within the bore port 81 as the port body 38 is extended from the valve body 24. In particular, as the port body 38 is extended from the valve body, a negative pressure will be created within the space between the closed sliding sleeve 44 and the sealing body (not shown) located within the aperture 40 as this space is increased in volume. The balancing bore 110 reduces this negative pressure by providing an additional fluid contained therein to be drawn into the port bore 81 to fill this volume and balance the pressure therein with the pressures to the exterior of the valve body 24. As illustrated in FIG. 7, the connection bore 112 may be formed by boring into the raised section 36 so as to intersect both the balancing bore 110 and the port bore 81 and thereafter filing the exterior portion of the connection bore with a plug 116 or the like.

Figure 9:
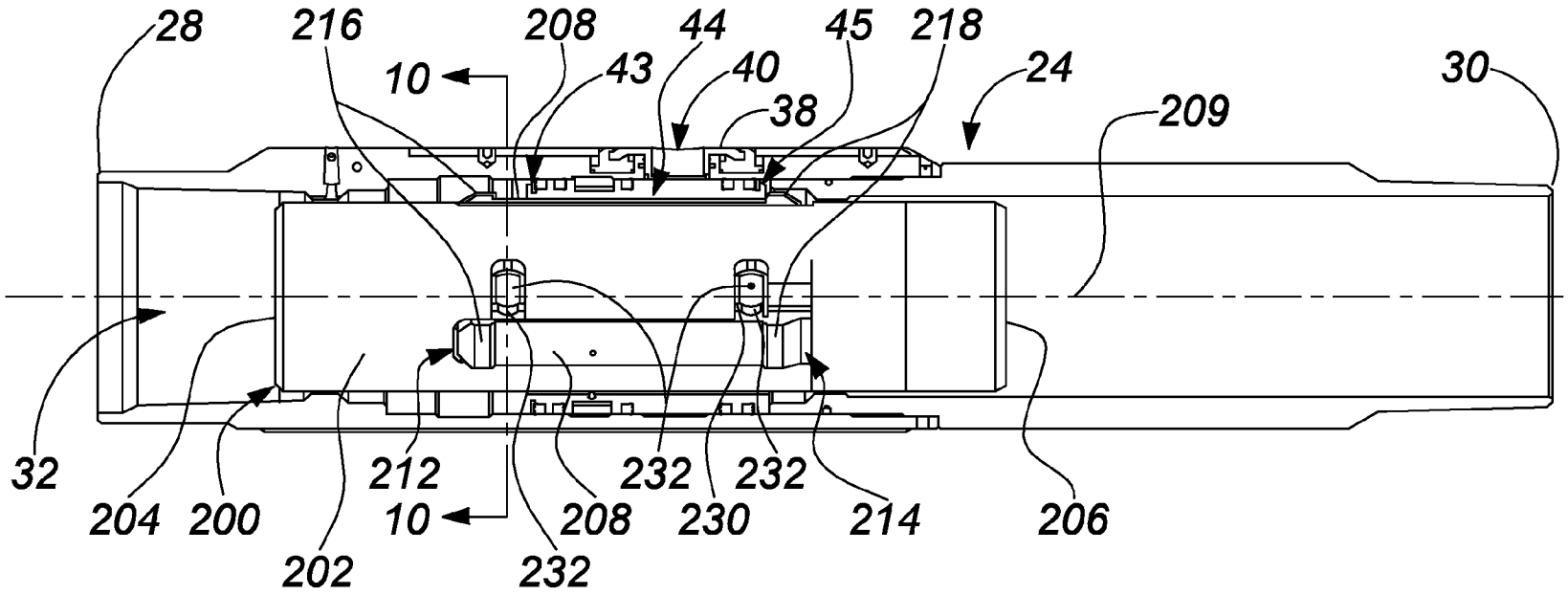
FIG. 9 is a cross sectional view of the valve of FIG. 2 as taken along the line 3-3 showing a shifting tool located therein.

Turning now to FIG. 9, a shifting tool 200 is illustrated within the central passage 32 of the valve body 24. The shifting tool 200 is adapted to engage the sliding sleeve 44 and shift it between a closed position as illustrated in FIG. 9 and an open position in which the apertures 40 are uncovered by the sliding sleeve 44 so as to permit fluid flow between and interior and an exterior of the valve body 24 as illustrated in FIG. 5. The shifting tool 200 comprises a substantially cylindrical elongate tubular body 202 extending between first and second ends 204 and 206, respectively. The shifting tool 200 includes a central bore 210 therethrough (shown in FIGS. 10 through 12) to receive an actuator or to permit the passage of fluids and other tools therethrough. The shifting tool 200 includes at least one sleeve engaging member 208 radially extendable from the tubular body 202 so as to be selectably engageable with the sliding sleeve 44 of the valve body 24. As illustrated in the accompanying figures, three sleeve engaging members 208 are illustrated although it will be appreciated that other quantities may be useful as well.

Figure 11:
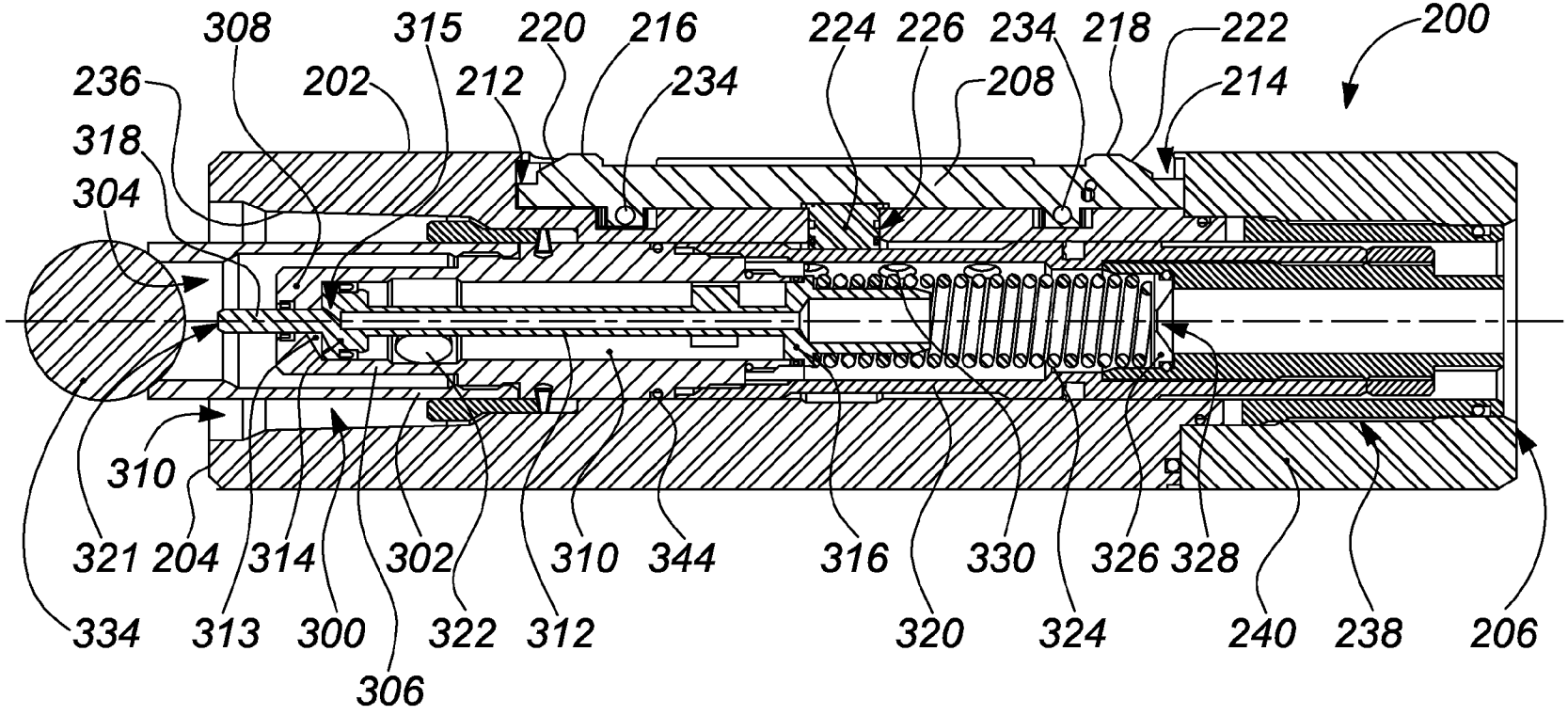
FIG. 11 a lengthwise cross sectional view of the shifting tool of FIG. 9 taken along the line 11-11 in FIG. 10 with a control valve located therein according to one embodiment with the shifting keys located at a first or retracted position.
Figure 12:
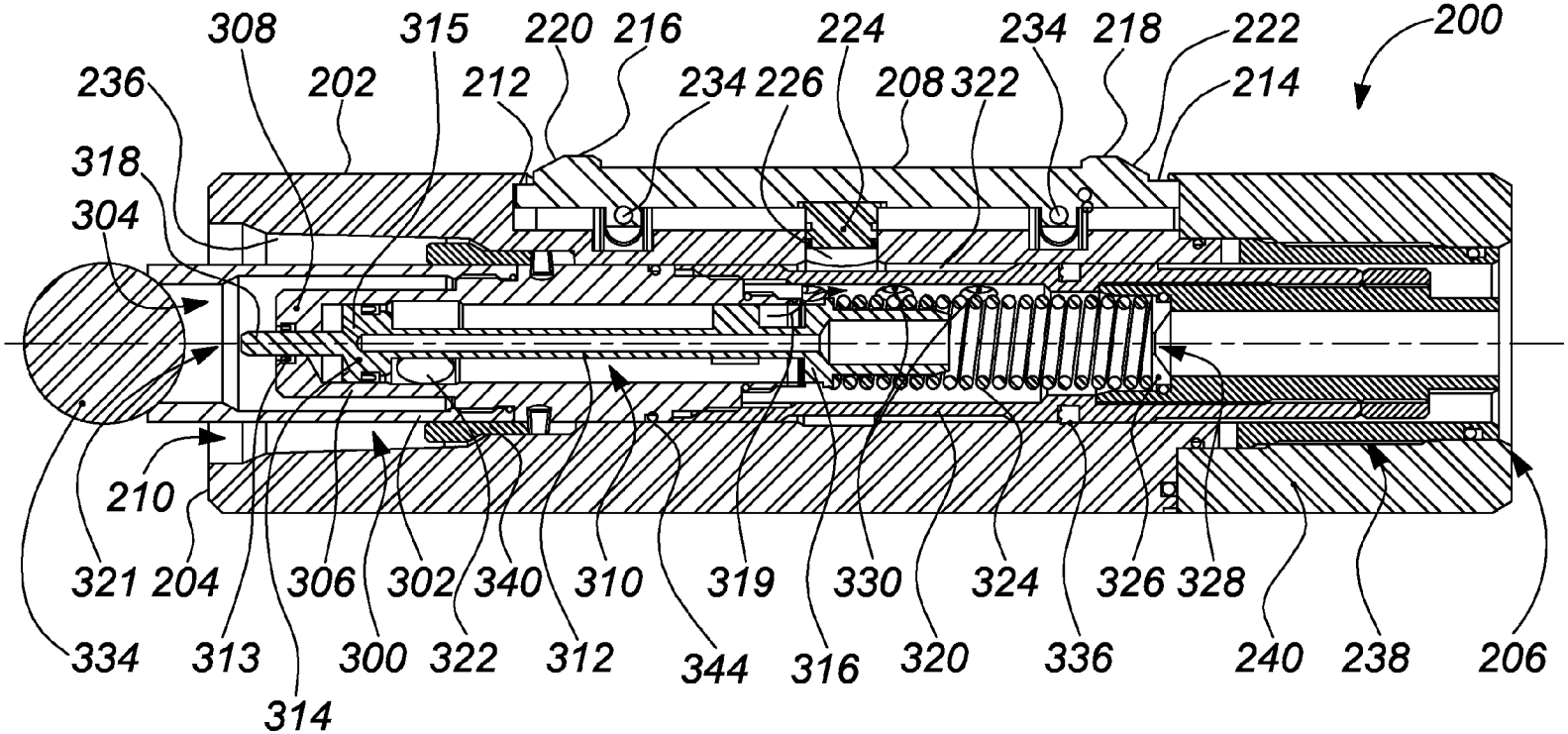
FIG. 12 is a cross sectional view of the shifting tool of FIG. 9 taken along the line 11-11 with a control valve located therein according to one embodiment with the shifting keys located at a second or extended position
Figure 17:
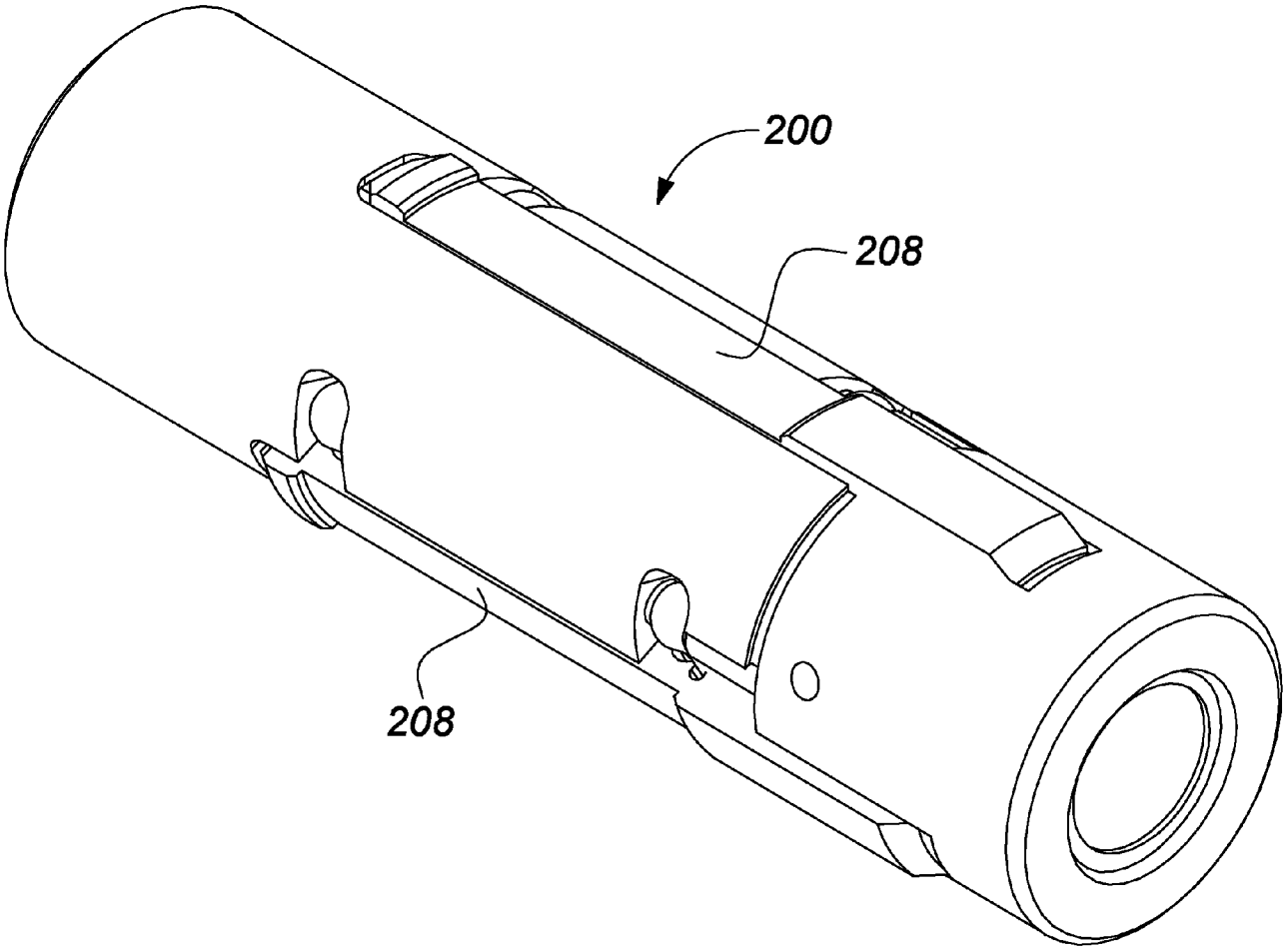
FIG. 17 is a perspective view of a shifting tool according to a further embodiment.

The sleeve engaging members 208 comprise elongate members extending substantially parallel to a central axis 209 of the shifting tool between first and second ends 212 and 214, respectively. The first and second ends 212 and 214 include first and second catches 216 and 218, respectively for surrounding the sliding sleeve and engaging a corresponding first or second end 43 or 45, respectively of the sliding sleeve 44 depending upon which direction the shifting tool 200 is displaced within the valve body 24. As illustrated in FIGS. 11 and 12, the first and second catches 216 and 218 of the sleeve engaging member 208 each include and inclined surface 220 and 222, respectively facing in opposed directions from each other. The inclined surfaces 220 and 222 are adapted to engage upon either the first or second annular shoulder 46 or 48 of the valve body as the shifting tool 200 is pulled or pushed there into. The first or second annular shoulders 46 or 48 press the first or second inclined surface 220 or 222 radially inwardly so as to press the sleeve engaging members 208 inwardly and thereby to disengage the sleeve engaging members 208 from the sliding sleeve 44 when the sliding sleeve 44 has been shifted to a desired position proximate to one of the annular shoulders. In an optional embodiment, one or both of the catches 216 or 218 may have an extended length as illustrated in FIG. 17 such that the sleeve engaging members are disengaged from the sliding sleeve at a position spaced apart from one of the first or second annular shoulders 46 or 48 and thereby adapted to position the sliding sleeve at a third or central position within the valve body 24.

Figure 10:
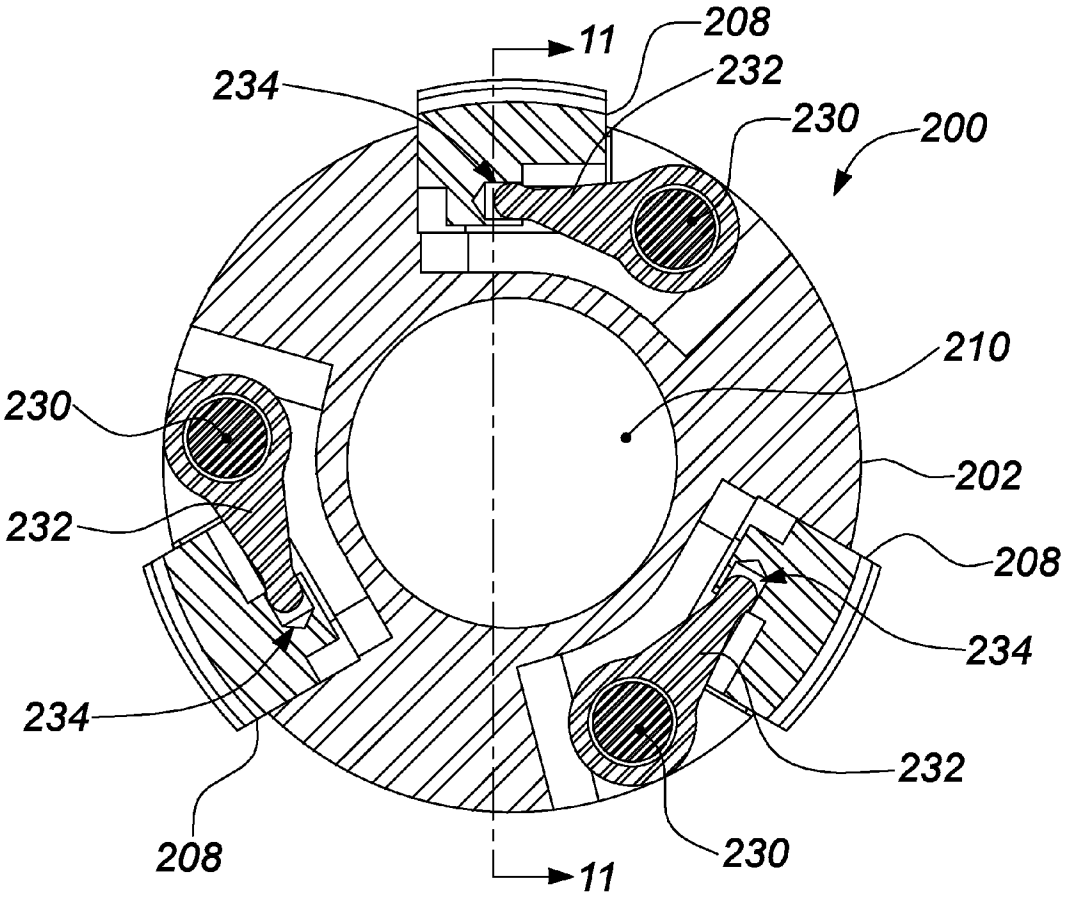
FIG. 10 is an axial cross-sectional view of the shifting tool of FIG. 9 as taken along the line 10-10.

Turning to FIG. 10, the sleeve engaging members are maintained parallel to the tubular body 202 of the shifting tool 200 by a parallel shaft 230. Each parallel shaft 230 is linked to a sleeve engaging member 208 by a pair of spaced apart linking arms 232. The parallel shaft 230 is rotatably supported within the shifting tool tubular body 202 by bearings or the like. The linking arms 232 are fixedly attached to the parallel shaft 230 at a proximate end and are received within a blind bore 234 of the sleeve engaging members 208. As illustrated in FIG. 9, the linking arms 232 are longitudinally spaced apart from each other along the parallel shaft 230 and the sleeve engaging member 208 so as to be proximate to the first and second ends 212 and 214 of the sleeve engaging member 208.

Turning now to FIG. 11, the tubular body 202 of the shifting tool includes a shifting bore 226 therein at a location corresponding to each sleeve engaging member. The shifting bore 226 extends from a cavity receiving the sleeve engaging member to the central bore 210 of the shifting tool 200. Each sleeve engaging member 208 includes a piston 224 extending radially therefrom which is received within the shifting bore 226. In operation, a fluid pressure applied to the central bore 210 of the shifting tool will be applied to the piston 224 so as to extend the piston within the shifting bore 226 and thereby to extend the sleeve engaging members 208 from a first or retracted position within the shifting tool tubular body 202 as illustrated in FIG. 11 to a second or extended position for engagement on the sliding sleeve 44 as discussed above as illustrated in FIG. 12. The parallel shafts also include helical springs (not shown) thereon to bias the sleeve engaging members to the retracted position.

The first end 204 of the shifting tool 200 includes an internal threading 236 therein for connection to the external threading of the end of a production string or pipe (not shown). The second end 206 of the shifting tool 200 includes external threading 238 for connection to internal threading of a downstream productions string or further tools, such as by way of non-limiting example a control valve as will be discussed below. An end cap 240 may be located over the external threading 238 when such a downstream connection is not utilized.

With reference to FIGS. 11 and 12, a first control valve 300 according to a first embodiment located within a shifting tool 200 for use in wells having low hydrocarbon production flow rates. The low flow control valve 300 comprises a valve housing 302 having a valve passage 304 therethrough and seals 344 therearound for sealing the valve housing 302 within the shifting tool 200. The low flow control valve 300 includes a central housing extension 306 extending axially within the valve passage 304 and a spring housing portion 320 downstream of the central portion 310. The central housing extension 306 includes an end cap 308 separating an entrance end of the valve passage from a central portion 310 of the valve passage and an inlet bore 322 permitting a fluid to enter the central portion 310 from the valve passage 304.

The central portion 310 of the valve passage contains a valve piston rod 312 slidably located therein. The valve piston rod 312 includes leading and trailing pistons, 314 and 316, respectively thereon in sealed sliding contact with the central portion 310 of the valve passage. The leading piston 314 forms a first chamber 313 with the end cap 308 having an inlet port 315 extending through the leading piston 314. The valve piston rod 312 also includes a leading extension 318 having an end surface 321 extending from an upstream end thereof and extending through the end cap 308. The valve piston rod 312 is slidable within the central portion 310 between a closed position as illustrated in FIG. 11 and an open position as illustrated in FIG. 12. In the closed position, the second or trailing piston 316 is sealable against the end of the central portion 310 to close or seal the end of the central passage and thereby prevent the flow of a fluid through the control valve. In the open position as illustrated in FIG. 12, the trailing piston 316 is disengagable from the end of the central portion 310 so as to provide a path of flow, generally indicated at 319, therethrough from the central passage to the spring housing.

A spring 324 is located within the spring housing 320 and extends from the valve piston rod 312 to an orifice plate 326 at a downstream end of the spring housing 320. The spring 324 biases the valve piston rod 312 towards the closed position as illustrated in FIG. 11. Shims or the like may be provided between the spring 324 and the orifice plate 326 so as to adjust the force exerted by the spring upon the valve piston rod 312. In other embodiments, the orifice plate may be axially moveable within the valve body by threading or the like to adjust the force exerted by the spring. In operation, fluid pumped down the production string to the valve passage 304 passes through the inlet bore and into the central portion 310. The pressure of the fluid within the central portion 310 is balanced upon the opposed faces of leading and trailing pistons 314 and 316 such that the net pressure exerted upon the valve piston rod 312 is provided by the pressure exerted on the end surface 321 of the leading extension 318 and on the leading piston 314 from within the first chamber 313. The resulting force exerted upon the end surface 321 is resisted by the biasing force provided by the spring 324 as described above.

Additionally, the orifice plate 326 includes an orifice 328 therethrough selected to provide a pressure differential thereacross under a desired fluid flow rate. In this way, when the fluid is flowing through the central portion 310 and the spring housing 320, the spring housing 320 will have a pressure developed therein due to the orifice plate. This pressure developed within the spring housing 320 will be transmitted through apertures 330 within the spring housing to a sealed region 332 around the spring housing proximate to the shifting bore 226 of the shifting tool 200. This pressure serves to extend the pistons 224 within the shifting bores 226 and thereby to extend the sleeve engaging members 208 from the shifting tool. The pressure developed within the spring housing 320 also resists the opening of the valve piston rod 312 such that in order for the valve to open and remain open, the pressure applied to the entrance of the valve passage 304 is required to overcome both the biasing force of the spring 324 and the pressure created within the spring housing 320 by the orifice 328.

The valve 300 may be closed by reducing the pressure of the supplied fluid to below the pressure required to overcome the spring 324 and the pressured created by the orifice 328 such that the spring is permitted to close the valve 300 by returning the valve piston rod 312 to the closed position as illustrate in 11 as well as permitting the springs on the parallel shaft 230 to retract the sleeve engaging members 208 as the pressure within the spring housing 320 is reduced. Seals 336 as further described below may also be utilized to seal the contact between the spring housing 320 and the interior of the central bore 210 of the shifting tool 200.

A shear sleeve 340 may be secured to the outer surface of the valve housing 302 by shear screws 342 or the like. The sheer sleeve 340 is sized and selected to be retained between a pipe threaded into the internal threading 236 of the shifting tool 200 and the remainder of the shifting tool body. In such a way, should the valve be required to be retrieved, a spherical object 334, such as a steel ball, such as are commonly known in the art may be dropped down the production string so as to obstruct the valve passage 304 of the valve 300. Obstructing the flow of a fluid through the valve passage 304 will cause a pressure to develop above the valve so as to shear the shear screws 342 and force the valve through the shifting tool. The strength of the sheer screws 342 may be selected so as to prevent their being sheered during normal operation of the valve 300 such as for pressures of between 1000 and 3000 psi inlet fluid pressure. The valve illustrated in FIGS. 11 and 12 is adapted for use in a low hydrocarbon flow rate well. In such well types, the flow of fluids such as hydrocarbons or other fluids is low enough that the fluid pumped down the well to pressurize the central portion 310 is sufficient to overcome the flow of the fluids up the well so as to pass through the orifice 328. It will be appreciated that for wells of higher well pressure or flow rates, such a valve will be limited in its application.

Figure 13:
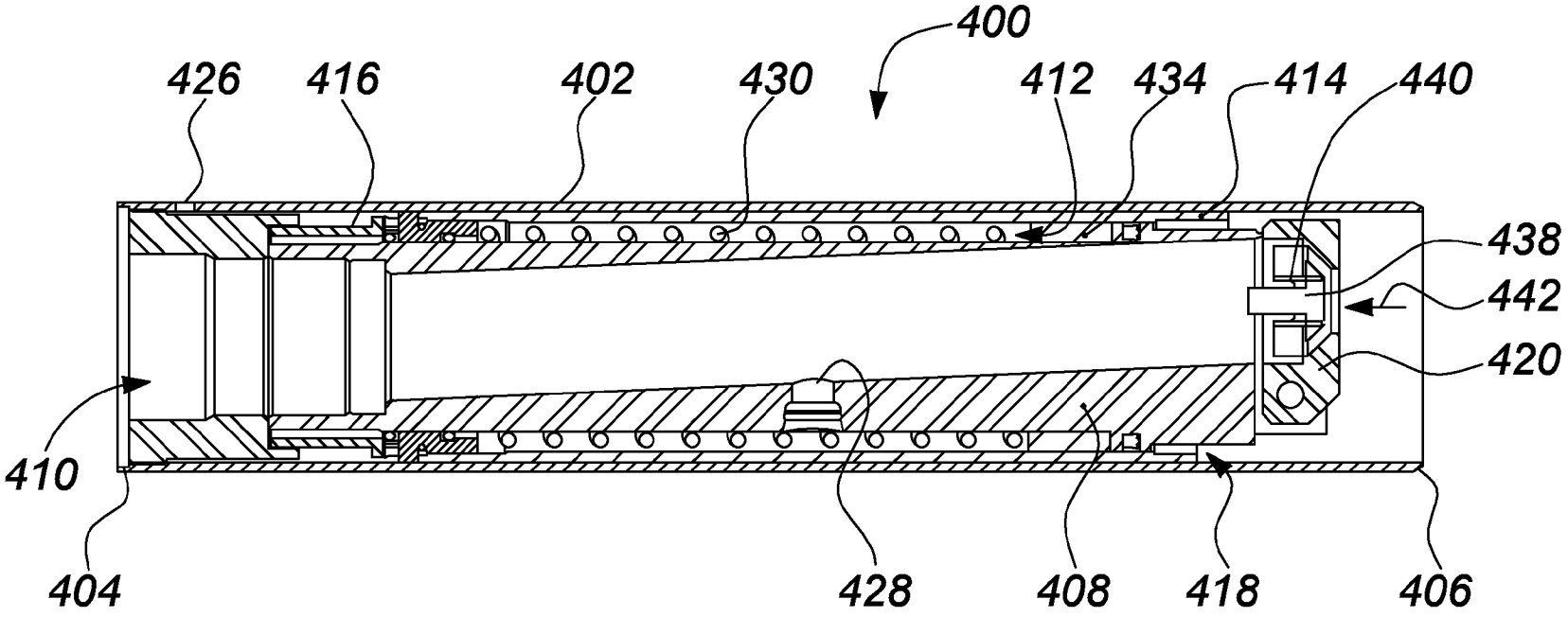
FIG. 13 is a cross sectional view of a control valve according to a further embodiment for actuating the shifting keys at a closed position.
Figure 14:
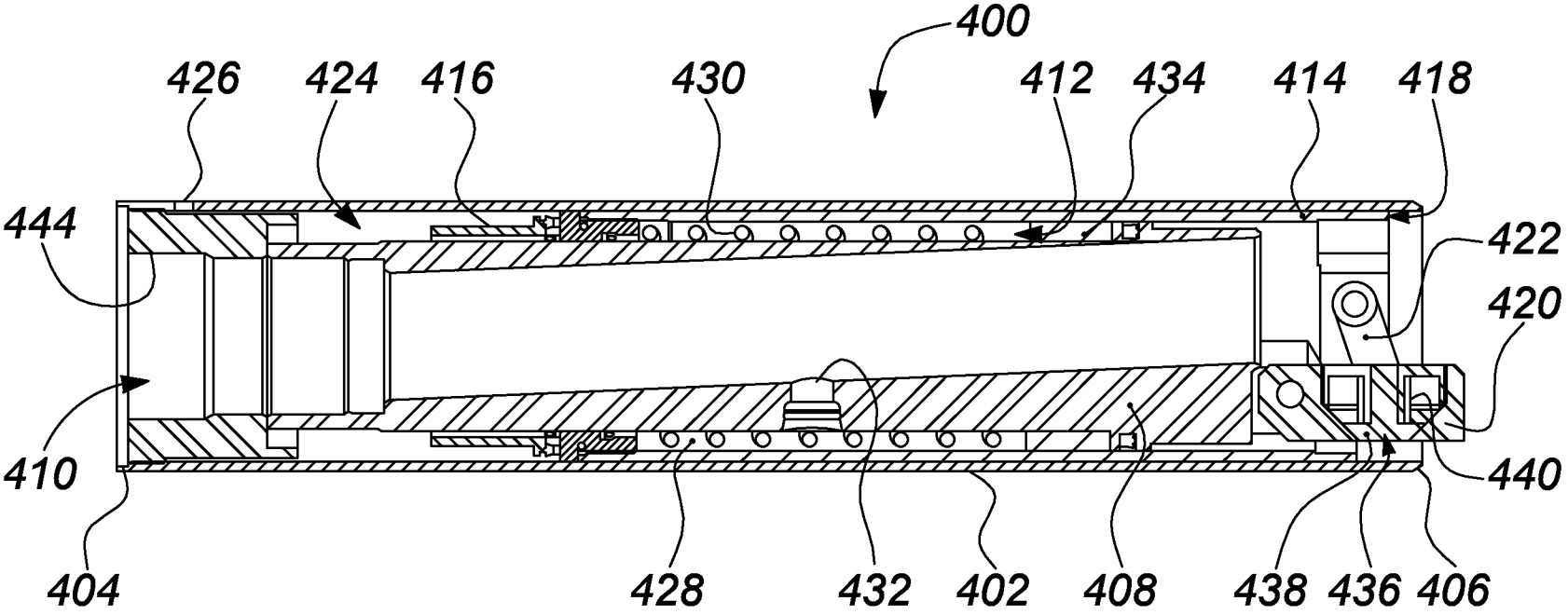
FIG. 14 is a cross sectional view of a control valve according to a further embodiment for actuating the shifting keys at an open position.

Turning now to FIGS. 13 and 14, a second control valve 400 according to a further embodiment located for use in wells having high hydrocarbon production flow rates is illustrated. The high flow control valve 400 comprises an outer tubular body 402 extending between first and second ends 404 and 406, respectively. An inner tubular body 408 is located within the outer tubular body 402 having a central passage 410 therethrough and forming an annular cavity 412 with the outer tubular body. A flap 420 is pivotally connected to a distal end of the inner tubular body 408. The flap 420 selectably closes and seals the central passage 410 as the flap 420 is rotated into a first or closed position as illustrated in FIG. 13. The flap 420 may also be rotated to a second or open position as illustrated in FIG. 14 so as to permit fluids and tools to be passed through second control valve 400.

An elongate longitudinally displacable sleeve 414 is received within the annular cavity 412. The sleeve 414 includes an annular piston 416 at a first end and a free second end 418. The second end 418 is connected to the flap 420 by a linkage 422 such that when flap 420 is rotated to the open position as illustrated in FIG. 14, the sleeve will be extended towards the second end 406 of the control valve 400. Similarly, when the flap 420 is rotated to the closed position as illustrated in FIG. 13, the sleeve 414 is retracted towards the first end 404.

The annular piston 416 is located within a first end 424 of the annular cavity 412 proximate to the first end 404 of the valve 400. The first end 424 is in fluidic communication with an annulus around the exterior of the outer tubular body 402 and also the distal end of the control valve 400 through a bore hole 426. The annular sleeve 414 is approximately hydrostatically balanced due to the same pressurized fluid from the wellbore being present at the second end 418 of the sleeve as well as upon the annular piston 416 within the first end 424. Biasing the annular piston 416 towards the first end of the control valve 400 is a spring 430 contained within a spring cavity 428 between the annular sleeve 414 and the outer tubular body 402. Additionally a spring cavity 428 may include an internal bore 432 from the central passage 410 so as to port or introduce a fluid into the spring cavity 428 and thereby prevent any fluid contained therein from acting as a further biasing spring. The force exerted upon the annular piston 416 may be adjusted by providing one or more shims 434 at an opposite end of the spring from the annular piston 416.

In a free resting state, the spring 430 biases the piston towards the first end 404 of the control valve and thereby maintains the flap 420 in the closed position. The flap 420 may be opened by pumping a fluid down the production string so as to introduce a pressurized fluid into the central passage thereof. The pressurized fluid forces the flap 420 open as illustrated in FIG. 14 when the flow and pressure of the pressurized fluid is sufficient to overcome the force of the spring 430.

The flap 420 may optionally include a check valve 436 therein comprising a plug 438 compressed into the flap 420 by a spring 440 or the like. When a closed flap 420 experiences a pressure from the bottom of the well greater than the set point of the check valve, the well pressure will displace the plug 438 against the spring 440 in a direction generally indicated at 442 in FIG. 13. This will then open the check valve and permit fluid to flow past the check valve in direction 442. The central passage 410 of the valve also includes internal threading 444 adapted to be threadably secured to the external threading 238 of a shifting tool as described above. In such a connection, it will be appreciated that the end cap 240 of the sleeve engaging member must be removed to permit access to the external threading 238.

In operation, the control valve 400 actuates the sleeve engaging members of the shifting tool by providing a pressurized fluid to the common passage through the shifting tool 200 and the valve 400. When the central passage is pressurized to a sufficient pressure by a fluid pumped down the production string, the fluid from the central passage forces the flap 420 open. Thereafter, the fluid will need to be pumped down the production string at a sufficiently high volume so as to maintain the pressure within the production string at a pressure sufficient to act upon the pistons 224 so as to extend the sleeve engaging members 208.

Figure 15:
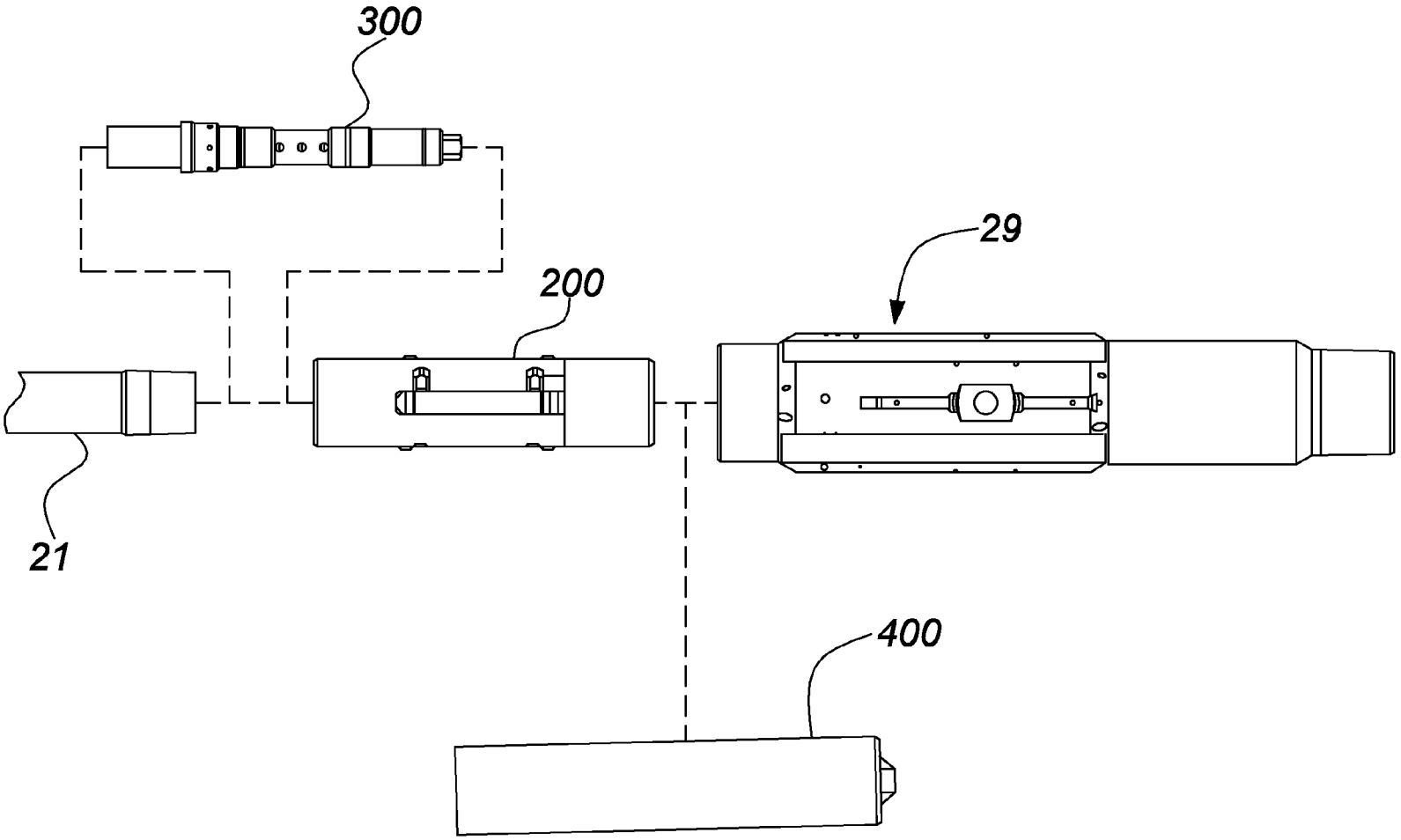
FIG. 15 is a schematic view of a system for controlling fluid flow through a wellbore.

Turning now to FIG. 15, a schematic view of a system according to the present invention is illustrated. The system may include one or more valve bodies 24 located within a bottom section 16 as described above. In operation, a user may extend a shifting tool 200 down the bottom section to shift the sliding sleeve 44 at the end of a production casing 21. The shifting tool 200 may be actuated by either the first valve 300 which is located within the shifting tool 200 or by the second valve 400 which is located to a distal end of the shifting tool.

Figure 16:
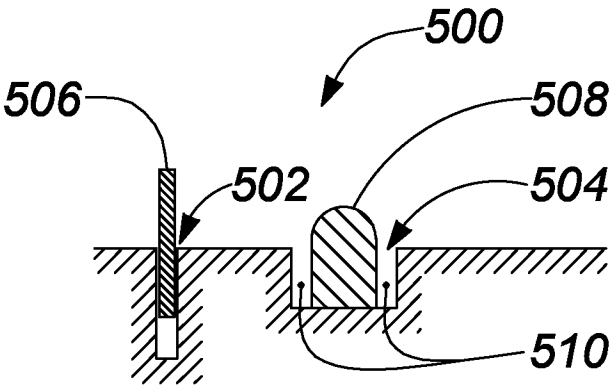
FIG. 16 is a cross sectional view of a seal for use between tool parts in a wellbore.

With reference to FIG. 16, one or more of the seals for use with the above system may comprise first and second spaced apart grooves 502 and 504, respectively. The first groove is sized to receive a wiper 506, such as a radially compressible ring having a gap therein as are commonly known in the art. As illustrated, the wiper 506 may have an uncompressed radius greater than the radius of the first groove 502 so as to provide a radial space into which the wiper may be compressed. The second groove is sized to receive a vulcanized rubber seal 508 therein such that a gap, generally indicated at 510 is left between the seal 508 and the sides of the second groove 504. The top of the seal 508 may be domed such that as the seal encounters an opposed surface (not shown) the seal is pressed down into the second groove to fill the gaps 510. The gaps 510 may have a distance of between 0.010 and 0.50 inches although it will be appreciated that other gap distances may be used as well. When the seal encounters a space in the opposed surfaces, such as for example at a port or the like the seal is permitted to expand to it's uncompressed shape to limit the volume of fluid which may be permitted to pass into the port.

While specific embodiments of the invention have been described and illustrated, such embodiments should be considered illustrative of the invention only and not as limiting the invention as construed in accordance with the accompanying claims.

What is claimed is:

1. An apparatus for centering a casing within a wellbore, the apparatus comprising:

a valve body locatable in-line with the casing, said valve body having an outer casing extending between first and second ends and a central passage therethrough, at least one radially movable body extending through said outer casing, each radially movable body having an aperture therethrough so as to permit an exterior of the valve body and said central passage to be in fluidic communication with each other; and a pair of cylinders located on opposed sides of said radially movable body and associated with said at least one radially moveable body in fluidic communication with said central passage, each cylinder having an associated piston therein operably connected to said radially movable body for radially moving said radially movable body, said pistons being located to opposed sides of said radially movable body, wherein each of said cylinders is in selective fluidic communication with said central passage such that a pressurized fluid in said central passage selectably displaces said pistons within said cylinders so as to extend said radially movable body.

2. The apparatus of claim 1 further comprising a fluid bore extending between an interior of the casing and said cylinders.

3. The apparatus of claim 2 wherein said fluid bore further includes a selectably removable plug.

4. The apparatus of claim 3 wherein said selectably removable plug selectably seals an inlet of said fluid bore within said central passage.

5. The apparatus of claim 4 wherein said plug is frangibly connected to said inlet of said fluid bore.

6. The apparatus of claim 2 wherein said fluid bore includes a lower limit pressure relief check valve for preventing actuation of said pistons in said cylinders until a fluid in said central passage reaches a predetermined pressure.

7. The apparatus of claim 2 wherein said fluid bore includes an upper limit pressure relief valve for preventing the pressure in said cylinders from exceeding a predetermined pressure.

8. The apparatus of claim 7 wherein said upper limit relief valve vents to an exterior of said valve body.

9. The apparatus of claim 1 wherein said radially movable body is movable between first and second positions, said first position being retracted into said valve body, said second position extending radially from said valve body.

10. The apparatus of claim 9 wherein said radially movable body includes an exterior surface, said exterior surface being substantially aligned with an exterior of said valve body in said first position.

11. The apparatus of claim 10 wherein said radially movable body extends from said valve body by a distance sufficient for said exterior surface to engage the wellbore in said second position.

12. The apparatus of claim 1 further comprising a valve member for selectably covering said aperture so as to isolate said central passage from an exterior of said valve body.

13. The apparatus of claim 12 wherein said valve member comprises an axially slidable sleeve located within said central passage.

14. A method of centering a valve body within a wellbore comprising:

locating a valve body in line with a wellbore, said valve body having an outer casing extending between first and second ends and a central passage therethrough;

providing at least one radially movable body extending through said outer casing, each radially movable body having an aperture therethrough so as to permit an exterior of the valve body and said central passage to be in fluidic communication with each other;

pressurizing said easing central passage with a pressurizing fluid; and transmitting said pressurizing fluid to a pair of cylinders located to opposed sides of said radially movable body within said valve body so as to displace a respective piston located within each of the cylinders and extend at least one radially movable body operably connected to said pistons.

* * * * *